US009463138B2

(12) United States Patent
McClain et al.

(10) Patent No.: US 9,463,138 B2
(45) Date of Patent: Oct. 11, 2016

(54) PACKAGING SYSTEM

(75) Inventors: Kimberly A. McClain, Salem, NJ (US); Michael Baklycki, Bensalem, PA (US); Thomas D. McDevitt, Richboro, PA (US)

(73) Assignees: BAXTER INTERNATIONAL INC., Deerfield, IL (US); BAXTER HEALTHCARE SA, Glattpark (Opfikon) (CH)

( * ) Notice: Subject to any disclaimer, the term of this patent is extended or adjusted under 35 U.S.C. 154(b) by 864 days.

(21) Appl. No.: 12/871,101

(22) Filed: Aug. 30, 2010

(65) Prior Publication Data

US 2010/0326868 A1 Dec. 30, 2010

Related U.S. Application Data

(63) Continuation of application No. 11/762,494, filed on Jun. 13, 2007.

(51) Int. Cl.

| | |
|---|---|
| ***B65D 85/00*** | (2006.01) |
| ***A61J 1/18*** | (2006.01) |
| ***B65D 23/08*** | (2006.01) |
| ***B65D 51/00*** | (2006.01) |

(Continued)

(52) U.S. Cl.

CPC ..... *A61J 1/18* (2013.01); *B65D 23/085* (2013.01); *B65D 51/002* (2013.01); *B65D 51/245* (2013.01); *B65D 55/0818* (2013.01)

(58) Field of Classification Search

USPC ..... 206/459.5, 459.1, 534, 534.2; 215/365, 215/366, 230; 229/89; 40/310

See application file for complete search history.

(56) References Cited

U.S. PATENT DOCUMENTS

| | | | |
|---|---|---|---|
| 828,770 | A | 8/1906 | Parrish |
| 2,666,542 | A | 1/1954 | Price |
| 2,954,139 | A | 9/1960 | Owens |

(Continued)

FOREIGN PATENT DOCUMENTS

| | | |
|---|---|---|
| EP | 0295104 | 12/1988 |
| EP | 0517610 | 12/1992 |

(Continued)

OTHER PUBLICATIONS

Label for use with ampul, and photographs of label as affixed to ampul (2 pages, as used in USA circa 1996).

(Continued)

*Primary Examiner* — Anthony Stashick
*Assistant Examiner* — Robert Poon
(74) *Attorney, Agent, or Firm* — Marshall, Gerstein & Borun LLP

(57) ABSTRACT

A packaging system includes a vial with a rim about an upper open end, and a neck between a lower closed end and the rim. The vial contains a pharmaceutical product. A valve is disposed over the open end, and a crimp ring is disposed over the valve with an opening defining an access port. A detachable cap is disposed over the access port. A single tubular label is disposed about the vial, and extends only from a first edge aligned with the closed end to a second edge at the cap. The label has first and second sections separated by a single circumferential perforated boundary aligned with the neck. The first section is backed with an adhesive and attached to the outer vial surface, and extends between the closed end and the boundary. The second section extends at least between the boundary and the cap.

11 Claims, 3 Drawing Sheets

(51) Int. Cl.
*B65D 51/24* (2006.01)
*B65D 55/08* (2006.01)

(56) References Cited

U.S. PATENT DOCUMENTS

| | | | |
|---|---|---|---|
| 3,015,429 | A | 1/1962 | Morici |
| 3,088,830 | A | 5/1963 | Graham |
| 3,490,163 | A | 1/1970 | Piper et al. |
| 3,733,002 | A | 5/1973 | Fujio et al. |
| 3,750,317 | A | 8/1973 | Morgan |
| 3,811,591 | A | 5/1974 | Novitch |
| 3,826,059 | A | 7/1974 | Novitch |
| 3,951,292 | A | 4/1976 | Amberg |
| 3,983,645 | A | 10/1976 | Rycroft |
| 3,984,005 | A | 10/1976 | Amberg |
| 4,312,523 | A | 1/1982 | Haines |
| 4,420,092 | A | 12/1983 | Finkelstein |
| 4,540,101 | A | 9/1985 | Kutcher |
| 4,546,881 | A | 10/1985 | Tasma |
| 4,633,648 | A | 1/1987 | Yeung |
| 4,641,362 | A | 2/1987 | Muller |
| 4,658,974 | A | 4/1987 | Fujita et al. |
| 4,724,973 | A | 2/1988 | Shah |
| 4,804,984 | A | 2/1989 | Heuer et al. |
| 4,813,559 | A | 3/1989 | Kenyon, 2nd |
| 4,895,266 | A | 1/1990 | Begley |
| 4,921,277 | A | 5/1990 | McDonough |
| 4,964,513 | A | 10/1990 | Ingram et al. |
| 4,976,798 | A | 12/1990 | Hoffman |
| 5,000,804 | A | 3/1991 | Nugent |
| 5,048,711 | A | 9/1991 | Weiss et al. |
| 5,205,827 | A | 4/1993 | Novacek et al. |
| 5,230,429 | A | 7/1993 | Etheredge, III |
| 5,284,263 | A | 2/1994 | Papciak |
| 5,292,018 | A | 3/1994 | Travisano |
| 5,383,558 | A | 1/1995 | Wilkinson et al. |
| 5,495,944 | A | 3/1996 | Lermer |
| 5,544,770 | A | 8/1996 | Travisano |
| 5,601,314 | A | 2/1997 | Burns et al. |
| 5,605,230 | A | 2/1997 | Marino, Jr. et al. |
| 5,727,819 | A | 3/1998 | Grosskopf et al. |
| 5,857,579 | A | 1/1999 | Finneran |
| 5,931,323 | A | 8/1999 | Wilkinson et al. |
| 5,967,559 | A | 10/1999 | Abramowitz |
| 6,146,729 | A | 11/2000 | Nihda et al. |
| 6,226,619 | B1 | 5/2001 | Halperin et al. |
| 6,276,725 | B1 | 8/2001 | Laurash et al. |
| 6,385,878 | B1 | 5/2002 | Key |
| 6,688,465 | B2 | 2/2004 | Arends et al. |
| 6,692,478 | B1 | 2/2004 | Paradis |
| 6,746,744 | B1 | 6/2004 | Ishihara et al. |
| 6,786,329 | B2 | 9/2004 | Onishi et al. |
| 6,908,113 | B2 | 6/2005 | Chaduc et al. |
| 6,955,000 | B2 | 10/2005 | Pawlik et al. |
| 7,225,598 | B2 | 6/2007 | Paoletti |
| 7,311,205 | B2 | 12/2007 | Adler et al. |
| 7,662,374 | B2 | 2/2010 | Greene et al. |
| 2004/0060892 | A1 | 4/2004 | Heston et al. |
| 2005/0023173 | A1 | 2/2005 | Paoletti |
| 2007/0130811 | A1 | 6/2007 | Shevelev et al. |
| 2007/0241075 | A1 | 10/2007 | Skillin et al. |
| 2008/0308443 | A1 | 12/2008 | Baklycki et al. |
| 2008/0308444 | A1 | 12/2008 | McClain et al. |

FOREIGN PATENT DOCUMENTS

| | | |
|---|---|---|
| GB | 158342 | 1/1921 |
| GB | 2240095 | 7/1991 |
| JP | 2000105536 | 4/2000 |
| JP | 2001130621 | 5/2001 |
| JP | 2005075387 | 3/2005 |
| JP | 2005178878 | 7/2005 |
| WO | WO 00/48161 | 8/2000 |

OTHER PUBLICATIONS

Photograph of five vials with labels affixed (1 page, as used in USA circa 2003-2004).

Insititute for Safe Medication Practices, *ISMP Medication Safety Alert!* (Oct. 7, 2004) (4 pages).

Institute for Safe Medication Practices, *ISMP Medication Safety Alert!* (Nov. 29, 2007) (3 pages).

Michael R. Cohen, *Medication Errors*, ch. 7 , *The Role of Drug Packaging and Labeling in Medication Errors* (2d ed. 2007) (42 pages in two separate electronic files).

PACKAGING SYSTEM

This application is a continuation of U.S. Ser. No. 11/762,494, filed Jun. 13, 2007, which is hereby incorporated herein by reference in its entirety in the present application.

BACKGROUND

This patent is directed to a packaging system and methods of use, and, in particular, to a packaging system with informational features and methods of use.

One common way of administering pharmaceutical products is by injecting the product in liquid form. Often, the liquid product will be packaged in a vial in a condition ready for administration. The vial will have a stopper at one end, through which a needle of a syringe may be passed so as to draw the product out of the vial.

A label is affixed to the outside of the vial so that a medical professional can determine the contents of the vial. A textual description of the product will be oriented about the periphery of the vial, or aligned with the axis of the vial. Sometimes, a portion or region of the label will be color-coded to differentiate different products and/or dosages for the professional that will be administering the product.

It is important that the label accurately convey the identification of the product and dosage to the administering professional. Certain pharmaceuticals (e.g., morphine) are so powerful that administration of the pharmaceutical except where indicated is to be avoided whenever possible. Other pharmaceutical products may contain the same active agent, but at different concentrations and, therefore, are intended for completely different purposes (compare Heparin and Hep-Lock products). In either instance, administration of a product where not indicated (or contraindicated) may have severe consequences, and may even lead to the death of the patient.

SUMMARY OF THE INVENTION

In one aspect, a packaging system includes a glass vial with a wall defining a lower closed end and an upper open end, the wall having an outer surface, an inner surface defining a receptacle, a flange-like rim disposed about the open end, and a neck of reduced diameter between the closed end and the rim below the rim. The system further includes a pharmaceutical product disposed in the receptacle, the product selected from the group of pharmaceutical products consisting of adrenergic agontists, adrenergic antagonists, anesthetic agents, antiarrhythmics, antithrombotic agents, chemotherapeutic agents, hypoglycemics, inotropic medications, sedation agents, opiates, neuromuscular blocking agents, and radiocontrast agents. The system also includes a valve disposed over the open end and a crimp ring with a first upper end disposed over a portion of the valve and having an opening to define an access port, and a second lower end disposed over a portion of the flange-like rim. A detachable cap is disposed over the access port, the cap terminating in a downturned edge about the circumference of the cap. In addition, a single tubular label is disposed about the perimeter of the vial, the tubular label extending only from a first lower edge aligned with the closed end of the vial to a second upper edge at the cap. The label has a first lower section and a second upper section separated by a single circumferential perforated boundary aligned with the neck of the vial below the rim. The first section of the label is backed at least in part with an adhesive, and is attached at least in part to the outer surface of the vial and extends between the closed end of the vial and the perforated boundary. The second section extends at least between the perforated boundary and the cap.

Additional aspects of the disclosure are defined by the claims of this patent.

DETAILED DESCRIPTION OF VARIOUS EMBODIMENTS

Figure 1:
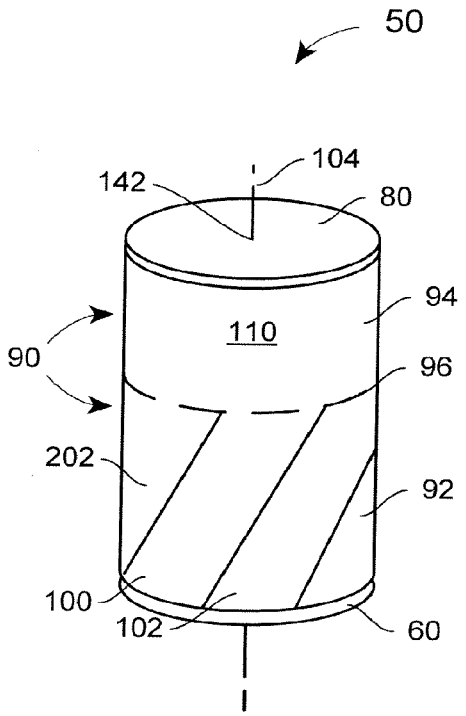
FIG. 1 is a perspective view of the packaging system according to the present disclosure with a two-part label, the label being intact.

Although the following text sets forth a detailed description of different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

FIGS. 1-5 illustrate an embodiment of packaging system 50 according to the present disclosure and its use. Packaging system 50 may be used for a pharmaceutical product, such as heparin or morphine. Alternatively, packaging system 50 may be used with other products. Examples of injectable drugs employed in system 50 may include, but are not limited to: abarelix, abciximab, acetazolamide, acetonide, acetylcysteine, acyclovir, adalimumab, adenosine, adipiodone, agalsidase beta, albumin, aldesleukin, aldesleukin, alefacept, alemtuzumab, alfentanil, alglucosidase, allopurinol, alpha 1-proteinase inhibitor, alphacon-1, alprostadil, alteplase, amifostine, amikacin, aminocaproic acid, aminophylline, amiodarone, amobarbital, amphotericin b, ampicillin, amrinone, anakinra, antithrombin iii, antivenom serum, apomorphine, aprotinin, aredia, argatroban, arginine, aripiprazole, asparaginase, atenolol, atracurium, atropine, aurothioglucose, axetil, azacitidine, azathioprine, azithromycin, aztreonam, bacillus calmette-guerin, bacitracin, basiliximab, benzoic acid, benztropine, betamethasone, bevacizumab, bivalirudin, bleomycin, bortezomib, botulinum a toxin, bretylium, bumetanide, bupivacaine, buprenorphine, busulfan, butorphanol, caffeine, calcitonin (salmon), calcitriol, capreomycin, carboplatin, carboprost, carmine, carmustine, carnitine, caspofungin, cefazolin, cefepime, cefotaxime, cefotetan, cefoxitin, ceftazidime, ceftizoxime, ceftriaxone, cefuroxime, cefuroxime, cetuximab, chloramphenicol, chloroprocaine, chlorothiazide, chlorpromazine, chondroitin, choriogonadotropin alfa, cidofovir, cilastatin, cimetidine, cinacalcet, ciprofloxacin, cisatracurium, cisplatin, cladribine, clavulanic acid, clindamycin, clofarabine, clonidine, codeine, colchicine, colistin, conivaptan, corticorelin, corticotrophin, cosyntropin, cyanocobalamin, cyclophosphamide, cyclosporine, cysteine, cytarabine, dacarbazine, daclizumab, dactinomycin, dalfopristin, dalteparin, dantrolene, daptomycin, darbepoetin alfa, daunorubicin, ddavp, decitabine, deferoxamine, denileukin diftitox, desmopressin, dexamethasone, dexmedetomidine, dexpanthenol, dexrazoxane, dextasone, diatrizoic acid, diazepam, diazoxide, dicyclomine, digibind, digoxin, dihydroergotamine, diltiazem, dimenhydrinate, diphenhydramine, dipyridamole, dobutamine, docetaxel, dolasetron, dopamine, dornase alfa, doxacurium, doxapram, doxercalciferol, doxorubicin, doxycycline, droperidol, drotrecogin alfa, dyphylline, eculizumab, edetic acid, edrophonium, efalizumab, enalaprilat, enoxaparin, ephedrine, epinephrine, epirubicin, epoetin alpha, epoprostenol, eptacog alfa, eptifibatide, ergocalciferol, ergocalciferol, ertapenem, erythromycin, erythropoietin alpha, esmolol, esomeprazole, estradiol, estrogen, etanercept, ethacrynic acid, ethanolamine, ethiodized oil, etidronic acid, etomidate, etoposide, exenatide, factor ii, factor ix, factor vii, factor viii, factor x, famotidine, fenoldopam, fentanyl, filgrastim, floxuridine, fluconazole, fludarabine, flumazenil, fluorescein, fluphenazine, follicle-stimulating hormone, follitropin, fomepizole, fondaparinux, foscarnet, fosphenytoin, fulvestrant, furosemide, gadobenic acid, gadodiamide, gadopentetate, gadoteridol, gadoversetamide, gallium, galsulfase, ganciclovir, ganirelex, gatifloxacin, gemcitabine, gemtuzumab, gentamicin, glatiramer, glucagon, glycopyrrolate, gm-csf, gold sodium thiomalate, gonadorelin, gonadotropin, goserelin, granisetron, haemophilus b polysaccaride, haloperidol, hemin, heparin, hetastarch, hexacetonide, histamine, hyaluronic acid, hyaluronidase, hydralazine, hydrocortisone, hydromorphone, hydroxocobalamin, hydroxyzine, hylan, hyoscyamine, hypromellose, ibuprofen, ibutilide, idarubicin, idursulfase, ifosfamide, imatinib mesylate, imiglucerase, imipenem, immune globulin, indigo, indomethacin, infliximab, insulin, interferons, iodine, iodixanol, iohexol, iopamidol, iopromide, iothalamic acid, ioversol, ioxaglic acid, ioxilan, irinotecan, iron dextran, isoniazid, isophane, isoproterenol, kanamycin, ketamine, ketorolac, labetalol, lansoprazole, laronidase, lepirudin, leucovorin, leuprolide, levetiracetam, levobupivacaine, levofloxacin, levothyroxine, lidocaine, lincomycin, linezolid, liothyronine, lispro, lorazepam, luteinising hormone, mechlorethamine, medroxyprogesterone, melphalan, meperidine, meperidine, mepivacaine, meropenem, mesna, metaraminol, methadone, methocarbamol, methohexital, methotrexate, methoxamine, methyldopate, methylene blue, methylergonovine, methylprednisolone, metoclopramide, metoprolol, metronidazole, micafungin, midazolam, milrinone, minocycline, mitomycin, mitoxantrone, mivacurium, mofetil, molybdenum, morphine, morrhuic acid, moxifloxacin, muromonab-cd3, mycophenolate, nafcillin, nalbuphine, nalmefene, naloxone, nandrolone, natalizumab, nelarabine, neostigmine, nesiritide, nicardipine, nitroglycerin, nitroprusside, norepinephrine, octreotide, olanzapine, omalizumab, ondansetron, oprelvekin, orphenadrine, ovine, oxacillin, oxaliplatin, oxymorphone, oxytetracycline, oxytocin, ozogamicin, paclitaxel, palifermin, palivizumab, palonosetron, pamidronic acid, pancuronium, panitumumab, pantoprazole, papaverine, paricalcitol, pegalated interferon alfa-2b, pegaptanib, pegaspargase, pegfilgrastim, pegvisomant, pegylated liposomal doxorubicin, pemetrexed, penicillin g, pentamidine, pentazocine, pentobarbital, pentostatin, phenobarbital, phentolamine, phenylacetic acid, phenylephrine, phenytoin, physostigmine, phytonadione, piperacillin, polymyxin b, porfimer, pralidoxime, pramlintide, prilocalne, procainamide, procaine, prochlorperazine, progesterone, promethazine, propofol, propranolol, protamine, pyridostigmine hydroxide, pyridoxine, quinidine, quinupristin, ranitidine, rasburicase, remifentanil, rho d immune globulin, rifampin, rituximab, rocuronium, ropivacaine, scopolamine, secretin, sermorelin, sincalide, somatrem, somatropin, spectinomycin, streptokinase, streptomycin, streptozocin, succinylcholine, sufentanil, sulbactam, sulfamethoxazole, sulphan blue, sumatriptan, tacrolimus, tazobactam, teniposide, terbutaline, teriparatide, testosterone, tetracaine, tetradecyl sulfate, theophylline, thiamine, thiopental, thiotepa, thyroid stimulating hormone, thyrotropin, ticarcillin, tigecycline, tinzaparin, tirofiban, tobramycin, topotecan, torsemide, tranexamic acid, trastuzumab, treprostinil, triamcinolone, triflutate, trimethobenzamide, trimethoprim, trimetrexate, triptorelin, tromethamine, tuberculin, typhoid vaccine, urofollitropin, urokinase, valproic acid, vancomycin, varicella, vasopressin, vecuronium, verapamil, verteporfin, vinblastine, vincristine, vinorelbine, voriconazole, warfarin, ziconotide, zidovudine, ziprasidone, and zoledronic acid. System 50, in its various embodiments, may also be useful for the provision of vaccines, vitamins and other nutritional agents.

Figure 2:
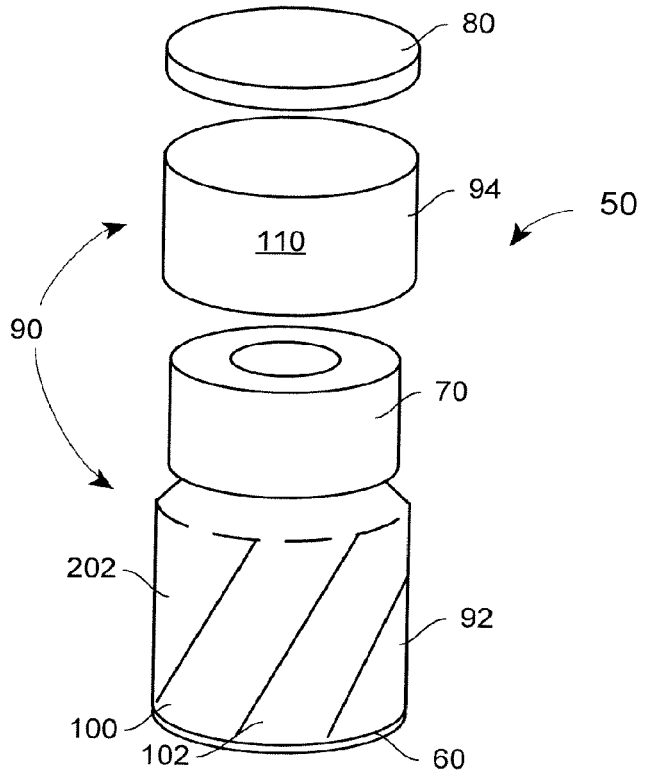
FIG. 2 is a perspective view of the packaging system of FIG. 1 with the sections of the label separated and the cap removed.

Referring to FIGS. 1 and 2, packaging system 50 includes container 60, closure assembly 70, cap 80, and label 90. Closure assembly 70 is fitted to an open end of container 60, and includes an access port. Closure assembly 70 may be resealable. Cap 80 is fitted over the access port, and label 90 is disposed about container 60.

Label 90 has first and second sections 92, 94, separated by perforated boundary 96. First section 92 of label 90 is attached at least in part to an outer surface of container 60. Label 90 may partially or fully cover the perimeter of container 60. First section 92 of label 90 covers container 60 up to perforated boundary 96. Second section 94 extends at least between perforated boundary 96 and cap 80.

First section 92 of label 90 has first region 100 and, optionally, second region 102. First and second regions 100, 102 extend from perforated boundary 96 to the opposing edge of first section 92. First and second regions 100, 102 are angled relative to longitudinal axis 104 of system 50 (see FIG. 5). First region 100 consists essentially of the name of a product to be packaged in container 60. Optional second region 102 consists essentially of a concentration of the product, or other description of the product. Second section 94 of label 90 may include informational or warning message 110.

Figure 3:
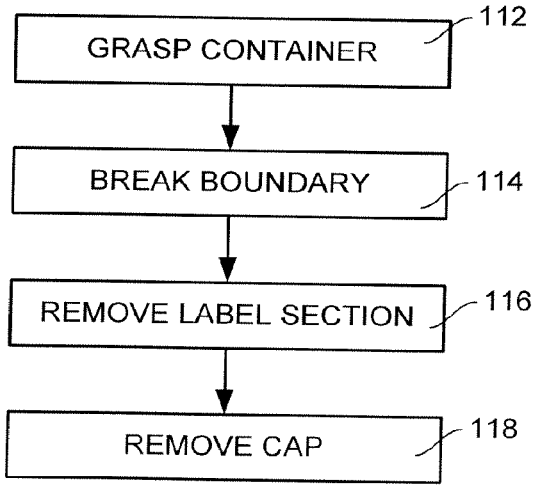
FIG. 3 is a flowchart illustrating the method of use of the packaging system of FIG. 1.

A method of use of packaging system 50 is illustrated in FIG. 3. First, a user grasps container 60 (block 112). The user then breaks label 90 along perforated boundary 96, thereby separating first section 92 of label 90 from second section 94 (block 114). Boundary 96 may be broken by grasping an edge of second section 94, preferably normal to the axis 104, and tearing second section 94 loose from first section 92 and cap 80. This motion also may result in removal of the section 94 (block 116). Finally, cap 80 may be removed from container 60 (118). Optionally, though not preferred, it is possible to remove cap 80 first, followed by the breaking of boundary 96. Also, the removal of section 92 and cap 80 may be achieved in a single step.

Packaging system 50 in general, and label 90 in particular, includes a number of informational features that assist the user administering the product packaged in container 60. For instance, label 90 has been designed to highlight the name and, optionally, the concentration of the product, or other description of the product. One way in which the name and concentration have been highlighted is through the unconventional orientation of regions 100, 102 of label 90, which regions 100, 102 are neither parallel nor orthogonal to axis 104. Further, by segregating essentially only the name and concentration to regions 100, 102, label 90 reduces the informational "clutter" that may accompany conventional presentations. System 50 also requires active manipulation of label 90 during the use of system 50, namely the separation of label 90 along perforated boundary 96. It is believed that active manipulation of label 90 will improve the user's appreciation of the informational content of label 90. Each of these features may contribute to the improvements provided by system 50.

Figure 4:
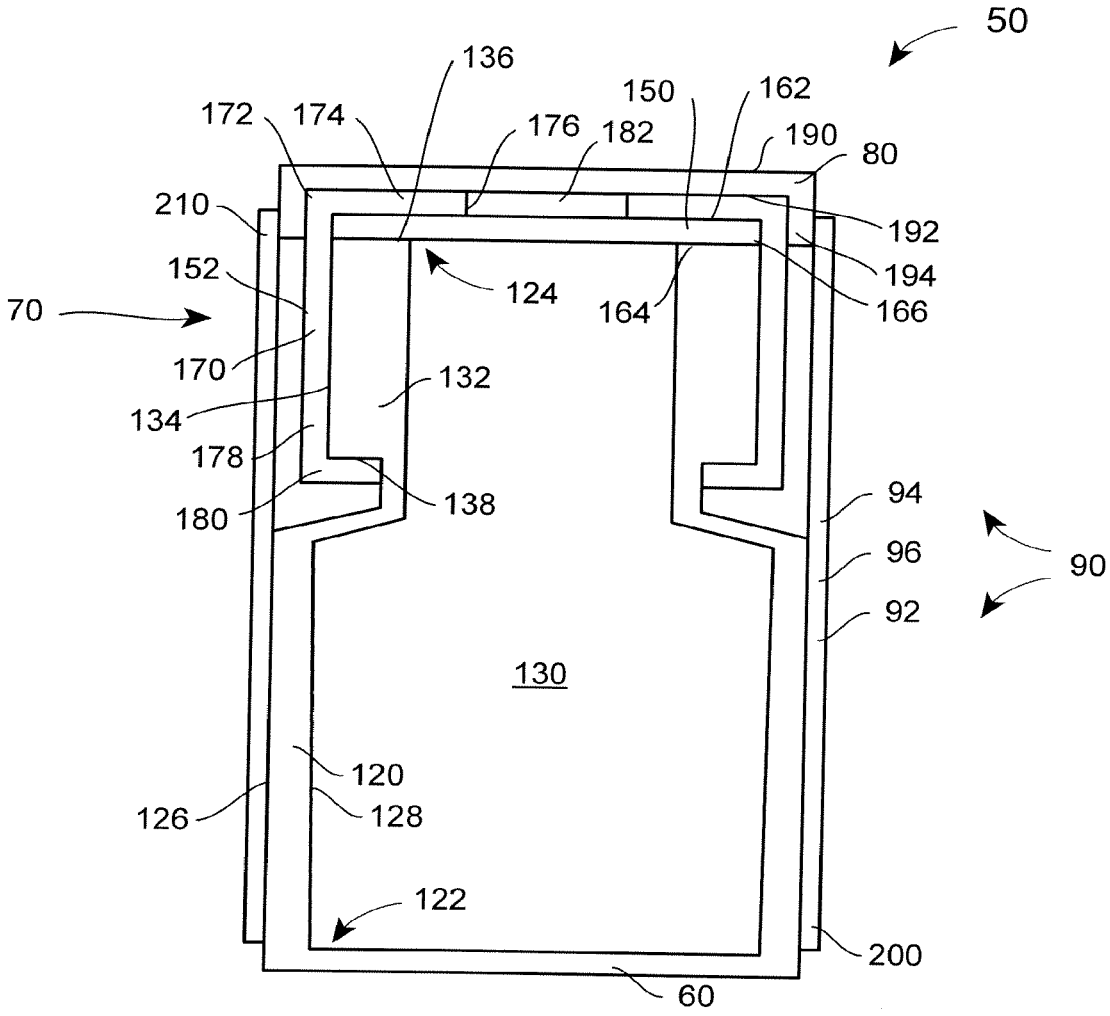
FIG. 4 is a cross-sectional view of the packaging system with the label intact as in FIG. 1.
Figure 5:
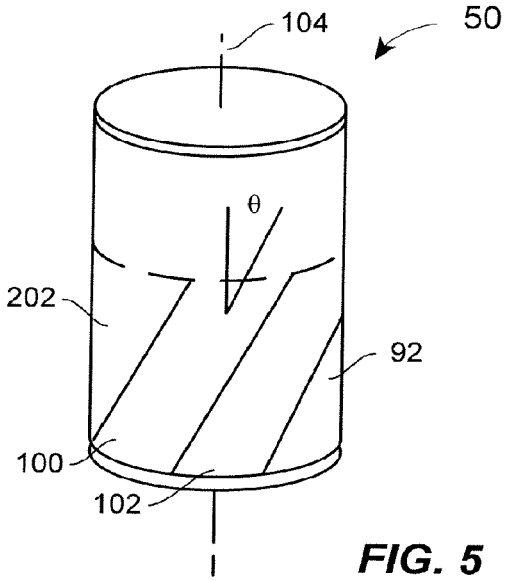
FIG. 5 is a perspective view of the packaging system illustrating the angle, taken relative to the longitudinal axis, of the first and second regions of the first section of the label.

The embodiment of system 50 illustrated in general terms in FIGS. 1 and 2 is now described in greater detail with regard to FIG. 4.

According to the present embodiment of system 50, container 60 may be in the form of a vial. Vial 60 may be cylindrical in shape, and may be made of materials such as glass or plastic, for example. The vial may have wall 120 that defines first, closed end 122 and second, open end 124. Wall 120 may have outer surface 126 and inner surface 128, which in turn defines receptacle 130. Wall 120 may also define flange-like rim 132 that is disposed about open end 124. Given the cylindrical shaped of vial 60, rim 132 may have an annular shape, with outermost edge 134 and opposing surfaces 136, 138.

As mentioned previously, system 50 has longitudinal axis 104. As illustrated best in FIGS. 1 and 5, closed end 122 and open end 124 of vial 60 may have a substantially circular shape, with centerpoints, one of which (142) is shown. According to at least the illustrated embodiment of vial 60, longitudinal axis 104 may pass through centerpoints 142 of closed and open ends 122, 124.

Fitted to open end 124 of vial 60 is closure assembly 70. According to the illustrated embodiment, closure assembly 70 may include valve 150 and crimp ring 152. Valve 150 controls access to open end 124 of vial 60, while crimp ring 152 maintains the position of valve 150 at open end 124.

Valve 150 may be defined by a layer of Teflon-coated rubber, the layer having opposing first and second surfaces 162, 164 and outer edge 166. Given the cylindrical geometry of vial 60, outer edge 166 of valve 150 may be circular in shape. Given the material used, the layer may be punctured repeatedly by a needle, for example, but reseal thereafter so as to limit movement of product disposed in receptacle 130 through open end 124.

Crimp ring 152 may be defined by cylindrical metal sleeve 170 having a cylindrical shape. Sleeve 170 has first end 172 with annular metal band 174 that defines circular opening 176. Sleeve 170 also has intermediate, tube-like portion 178 and second end 180.

As assembled, valve 150 is disposed with second surface 164 disposed over open end 124 of vial 60 abutting surface 136. Edge 166 of valve 150 may, but need not necessarily, extend to outermost edge 134 of rim 132. Crimp ring 152 may be disposed over the assembly of valve 150 and vial 60, such that first end 172 abuts first surface 162 of valve 150. Opening 176 thereby defines access port 182 for closure assembly 70. With first end 172 abutting first surface 162, second end 180 is disposed over and about rim 132 such that second end 180 abuts surface 138.

Disposed over access port 182 is cap 80. Cap 80 may be made of a plastic or metal material. Cap 80 may have opposing surfaces 190, 192 and downturned edge 194. Cap 80 is disposed over crimp ring 152 such that surface 192 abuts first end 172 of ring 152. Furthermore, cap 80 may be attached to closure assembly 70, and in particular the portion of closure assembly 70 that defines access port 182, with a releasable adhesive or by friction fitting, for example.

Returning to label 90, label 90 may be made of paper or other material suitable for printing that has been backed, at least in part, with an adhesive. The adhesive used with label 90 may require label 90 to be torn to remove label 90 from the surface to which it is affixed. First section 92 of label 90 may be attached at least in part to outer surface 126 of vial 60. Second section 94 of label 90 may be attached at least in part to cap 80, and in particular edge 194.

First section 92 may extend from first edge 200 generally aligned with closed end 122 of vial 60 to perforated boundary 96. First region 100 of first section 92 may thus extend substantially from closed end 122 of vial 60 to perforated boundary 96. Similarly, second region 102 of first section 92 may also substantially extend from closed end 122 to perforated boundary 96.

First and second regions 100, 102 may, as noted above, be angled relative to longitudinal axis 104. The nature of this relationship is shown particularly in FIG. 5. As will be noted, to be angled relative to the longitudinal axis means that regions 100, 102 are not aligned with axis 104 (parallel to axis 104), nor do regions 100, 102 lie in a plane that is orthogonal or substantially orthogonal to longitudinal axis 104. Rather, regions 100, 102 lie in planes that make non-zero, non-right angle $\theta$ with longitudinal axis 104. By contrast, the text in remainder 202 of first section 92 may be aligned either along axis 104 or orthogonal or substantially orthogonal to axis 104.

According to certain embodiments, the angle of regions 100, 102 relative to axis 104 may lie in the range of between twenty and eighty degrees, and more preferably in the range of between thirty degrees and sixty degrees. As illustrated, the angle may be forty-five degrees. Shallower and steeper angles may be possible in certain embodiments.

However, in selecting the angle of regions 100, 102, it is presently believed that the angle should not be selected so shallow as to extend region 100, 102 more than half-way about the periphery of container 60. That is, if region 100, 102 extends through more than about 180 degrees about the periphery of container 60, the user may not be able to visualize all of the information contained in region 100, 102 at a single time. To maximize the possibility that all of the information in a given region 100, 102 may be read by the user at one time, the angle of inclination of region 100, 102 may thus be limited.

First and second regions 100, 102 may have a contrasting background color in regard to remainder 202 of first section 92 of label 90. That is, if remainder 202 of label 90 has a tan background color, for example, regions 100, 102 may have a neutral color or white for the background color. A contrasting background color may further differentiate regions 100, 102 in combination with the angled nature of regions 100, 102.

A still further differentiation of regions 100, 102, and in particular the text used in regions 100, 102, may be provided through the use of a contrasting font type or font size. For example, while the text in remainder 202 of first section 92 of the label may have a six point font size, the text in regions 100, 102 may have a ten point font size. In fact, it may be recognized that by angling regions 100, 102 relative to axis 104, regions 100, 102 may include more area than a region oriented parallel to or orthogonal to axis 104, thus permitting use of a larger font size. Similar to the contrasting background color, the contrasting background font may further differentiate regions 100, 102. Any font size may be printed on regions 100, 102 and sections 92, 94, so long as such sizes identify the product, other descriptions and warnings to the user of the product.

It will be recognized that while the illustrated embodiment uses angled regions 100, 102 with contrasting color and font size, it is not a requirement of the present disclosure that all three features be used in combination. For example, angled regions 100, 102 may be used in combination with neither, either or both of the contrasting color and the contrasting font size.

Second section 94 may extend from perforated boundary 96 to second edge 210. Second edge 210 may be disposed above edge 194 of cap 80. According to certain embodiments, such as the embodiment illustrated, second edge 210 may be generally aligned with first surface 190 of cap 80.

Second section 94 may have a contrasting background color relative to first section 92 of label 90. In particular, while first section 92 may feature background colors of tan and white, for example, second section 94 may feature a background color such as red. Preferably, colors such as red, orange and fluorescent yellow may be used for the background color of second section 94. Any color combination may be employed in sections 92, 94, but preferably such section colors contrast to aid the practitioner in using system 50. As noted above, it is not necessary for all embodiments of present system 50 to use such colors, although it may aid in differentiating warning message 110 displayed in second section 94 from other portions of label 90.

Warning message 110 may be textual, in the form of alphanumeric characters, for example. However, warning message 110 is not limited to alphanumeric characters. For example, icons or symbols may be used in combination with or in substitution for alphanumeric message 110. For that matter, message 110 may be conveyed without any icons, symbols, or characters at all, but by the color of section 94 alone. If a textual message is incorporated into warning message 110, then the font size of the text may be varied relative to that used in one or more regions 100, 102, 202 of first section 92 of label 90 to create differentiation.

It will be further recognized that a number of variants are possible, not only relative to the structures already discussed, but relative to additional features that may be combined with or substituted for those already described.

Figure 6:
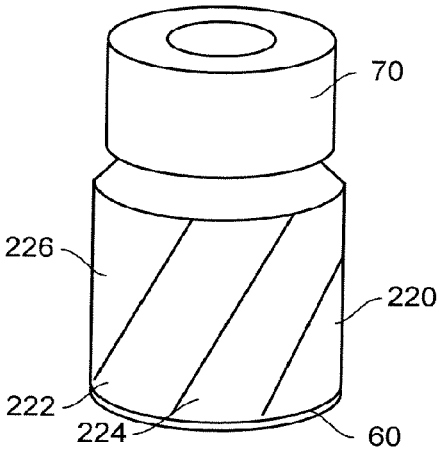
FIG. 6 is a perspective view of an alternative embodiment of the packaging system according to the present disclosure with a one-part label.

For example, second section 92 of label 90 may be optional, and may not be included according to all embodiments of system 50 according to the present disclosure. An illustration of such an embodiment is illustrated in FIG. 6, with similar parts numbered similarly. Label 220 is disposed about vial 60. Label 220 has a single section with first region 222 and, optionally, second region 224. The remainder of label 220 is indicated as 226. Regions 222, 224 lie in planes that make a non-zero, non-right angle with a longitudinal axis of the vial 60, similar to regions 100, 102. In general, other than the fact that the label 220 has but a single section, the comments made relative regions 100, 102 and remainder 202 may apply with equal force to regions 222, 224 and reminder 226. In fact, such a label with angled regions may be used with containers other than a vial, as shown; the label may be used with ampuls, syringes, and other devices. It will also be recognized that the perforated boundary may be used in a label without the angled regions in the first section of the label.

As another example of an alternative embodiment, crimp ring 152 may have a color that contrasts with one or more of regions 100, 102, 202 of first section 92 of label 90. In this regard, color of crimp ring 152 may preferably be red, orange or fluorescent yellow, similar to the color of second section 94 of label 90.

Further, crimp ring 152 may have a warning message displayed on a portion or area of ring 152. For example, ring 152 may have a warning message defined or displayed on intermediate region 178 between first and second ends 172, 180. Alternatively, the warning message may be defined or displayed on band 174 disposed about opening 176 that defines, in part, access port 182. Similar comments to those made above relative to warning message 110 may be made in regard to the warning message displayed on crimp ring 152.

Figure 7:
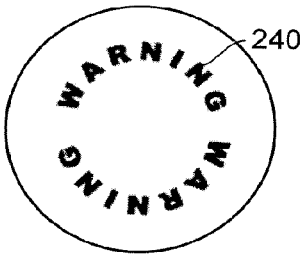
FIG. 7 is a plan view of an alternative embodiment of a cap for use with the packaging system of FIG. 1.

Additionally or in the alternative, warning message 240 may be displayed or defined on a portion or area of cap 80. For example, the message may be displayed or defined on surface 190 of cap 80. In particular, as illustrated in FIG. 7, message 240 may be disposed about the periphery of surface 190 of cap 80.

What is claimed is:

1. A packaging system comprising:

a glass vial including a wall defining a lower closed end and an upper open end, the wall having an outer surface, an inner surface defining a receptacle, a flange-like rim disposed about the open end, and a neck of reduced diameter between the closed end and the rim below the rim;

a pharmaceutical product disposed in the receptacle, the product selected from the group of pharmaceutical products consisting of adrenergic agontists, adrenergic antagonists, anesthetic agents, antiarrhythmics, antithrombotic agents, chemotherapeutic agents, hypoglycemics, inotropic medications, sedation agents, opiates, neuromuscular blocking agents, and radiocontrast agents;

a valve disposed over the open end and a crimp ring with a first upper end disposed over a portion of the valve and having an opening to define an access port, and a second lower end disposed over a portion of the flange-like rim;

a detachable cap disposed over the access port, the cap terminating in a downturned edge about the circumference of the cap; and a single tubular label disposed about the perimeter of the vial, the tubular label extending only from a first lower edge aligned with the closed end of the vial to a second upper edge at the cap, the label having a first lower section and a second upper section separated by a single circumferential perforated boundary aligned with the neck of the vial below the rim, the first section of the label backed at least in part with an adhesive, attached at least in part to the outer surface of the vial and extending between the closed end of the vial and the perforated boundary, and the second section extending at least between the perforated boundary and the cap.

2. The system according to claim 1, the vial comprising a longitudinal axis, and wherein in a first state, the first and second sections of the label are joined at the perforated boundary, in a second state, the first section of the label is separated from the second section of the of the label with a motion normal to the axis of the vial as the label is broken along the perforated boundary about the axis of the vial, and in a third state, the cap is removed by engaging the downturned edge upward.

3. The system according to claim 1, wherein the pharmaceutical product is selected from the group of pharmaceutical products consisting of epinephrine, phenylephine, norepinephrine, propranolol, metoprolol, labetalol, propofol, ketmine, lidocaine, amiodarone, warfarin, heparin, fondaparinux, argatroban, lepirudin, biavalirudin, alteplase, eptifibatide, docetaxel, insulin, exenatide, pramlintide, digoxin, milrinone, midazolam, morphine, codeine, papaverine, succinylcholine, rocuronium, vecuronium, ioxaglic acid, diatrizoic acid, colchicine, epoprostenol, methotrexate, oxycotin, nitroprusside, and promethazine.

4. The system according to claim 1, wherein the pharmaceutical product is selected from the group of pharmaceutical products consisting of heparin and midazolam.

5. The packaging system of claim 1, wherein the crimp ring is of a color that contrasts with the first section of the label.

6. The packaging system of claim 1, wherein the cap has a top surface and comprises a warning message defined on the top surface.

7. The system according to claim 1, wherein the label partially covers the perimeter of the vial.

8. The system according to claim 1, wherein the label fully covers the perimeter of the vial.

9. The system according to claim 1, wherein the second section of the label is attached at least in part to the cap.

10. The system according to claim 9, wherein the label is attached to the downturned edge of the cap.

11. The system according to claim 10, wherein the second edge of the label is aligned with a top surface of the cap.

* * * * *